US010227706B2

(12) United States Patent
Wilson et al.

(10) Patent No.: US 10,227,706 B2
(45) Date of Patent: Mar. 12, 2019

(54) ELECTROPLATING APPARATUS WITH ELECTROLYTE AGITATION

(71) Applicant: APPLIED Materials, Inc., Santa Clara, CA (US)

(72) Inventors: Gregory J. Wilson, Kalispell, MT (US); Paul R. McHugh, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 678 days.

(21) Appl. No.: 14/806,255

(22) Filed: Jul. 22, 2015

(65) Prior Publication Data

US 2017/0022624 A1 Jan. 26, 2017

(51) Int. Cl.

| | |
|---|---|
| ***C25B 9/00*** | (2006.01) |
| ***C25D 17/00*** | (2006.01) |
| ***C25D 21/10*** | (2006.01) |
| ***C25D 5/08*** | (2006.01) |

(52) U.S. Cl.

CPC ..... *C25D 17/001* (2013.01); *C25D 5/08* (2013.01); *C25D 21/10* (2013.01)

(58) Field of Classification Search

CPC ..... C25D 17/001; C25D 17/00; C25D 21/10; C25D 5/08; C25B 9/00

USPC ..... 204/237

See application file for complete search history.

(56) References Cited

U.S. PATENT DOCUMENTS

| | | | | |
|---|---|---|---|---|
| 6,602,383 | B1 | 8/2003 | Batz, Jr. et al. | |
| 7,160,421 | B2 | 1/2007 | Wilson et al. | |
| 7,351,315 | B2 | 4/2008 | Klocke et al. | |
| 7,390,382 | B2 | 6/2008 | McHugh et al. | |
| 7,390,383 | B2 | 6/2008 | McHugh et al. | |
| 7,931,786 | B2 | 4/2011 | Wilson et al. | |
| 8,920,616 | B2 | 12/2014 | Chen et al. | |
| 2002/0020621 | A1 | 2/2002 | Uzoh et al. | |
| 2002/0029961 | A1 | 3/2002 | Dordi et al. | |
| 2004/0245094 | A1* | 12/2004 | McHugh | C25D 17/001 204/253 |
| 2007/0144912 | A1 | 6/2007 | Woodruff | |
| 2007/0151844 | A1 | 7/2007 | Wilson et al. | |
| 2008/0110751 | A1 | 5/2008 | Oberlitner et al. | |
| 2012/0199475 | A1* | 8/2012 | McHugh | C25D 17/001 204/273 |
| 2013/0334051 | A1 | 12/2013 | Chen et al. | |

(Continued)

OTHER PUBLICATIONS

Applied Materials, Figure 2, 10mm Pitch, Uniform Height Paddle Blades 2.44mm Gap (Jan. 2012).

(Continued)

*Primary Examiner* — Zulmariam Mendez

(74) *Attorney, Agent, or Firm* — Perkins Coie LLP; Kenneth H. Ohriner

(57) ABSTRACT

Electroplating apparatus agitates electrolyte to provide high velocity fluid flows at the surface of a wafer. The apparatus includes a paddle which provides uniform high mass transfer over the entire wafer, even with a relatively large gap between the paddle and the wafer. Consequently, the processor may have an electric field shield positioned between the paddle and the wafer for effective shielding at the edges of the wafer. The influence of the paddle on the electric field across the wafer is reduced as the paddle is spaced relatively farther from the wafer.

19 Claims, 5 Drawing Sheets

(56) References Cited

U.S. PATENT DOCUMENTS

| | | | |
|---|---|---|---|
| 2014/0251814 | A1 | 9/2014 | Kao et al. |
| 2015/0075976 | A1 | 3/2015 | Harris et al. |

OTHER PUBLICATIONS

Applied Materials, Figure 4, "Raise Rib" Raider-S Paddle 16mm Pitch Cavity (Jan. 2012).

* cited by examiner

ELECTROPLATING APPARATUS WITH ELECTROLYTE AGITATION

TECHNICAL FIELD

The field of the invention is apparatus and methods for agitating liquid electrolyte in an electroplating apparatus.

BACKGROUND OF THE INVENTION

In many plating processes, a diffusion layer forms in the liquid electrolyte at the surface of the wafer. The diffusion layer reduces the mass transfer rate of electrolyte components and reactants to the surface of the wafer, which degrades the quality and efficiency of the plating process. One technique for increasing the mass transfer rate is to increase the relative velocity between the liquid electrolyte and the surface of the workpiece. In the past, some processing apparatus have used a paddle which oscillates horizontally or vertically in the electrolyte. The paddle has spaced apart ribs or blades. As the paddle moves, a liquid vortex is formed in the spaces between adjacent ribs. The liquid vortex creates a high speed agitated flow at or against the lower (down-facing) surface of the workpiece, increasing the mass transfer rate.

These types of paddle plating apparatus also often have an electric field shield provided to shield the edges of the wafer from the full electric field in the electrolyte, to achieve more uniform plating at the edges of the wafer. The shield is usually an annular ring of di-electric material.

Both the paddle and the shield are most effective when positioned very close to the wafer, for example, within 5 mm. If the shield is positioned below the paddle, the shield is less effective. If the shield is positioned above the paddle, then the paddle is less effective, as the gap between the paddle and the wafer is larger. Accordingly, engineering challenges remain in designing electro-plating apparatus.

SUMMARY OF THE INVENTION

Experimental and computation results disclose a relationship between the dimension of the gap between the paddle and the wafer, and the vortex size for achieving improved mass transfer. Specifically, the inventors have discovered that in processor designs having a larger gap, using a paddle which creates larger vortices provides improved results. Consequently, in designs having a shield is at a vertical position above the paddle, making the gap larger, a paddle having ribs spaced farther apart provides better mass transfer by creating larger vortices. The vortices may also be made more consistently across the wafer providing more uniform mass-transfer.

In one aspect, an electroplating apparatus agitates electrolyte to provide high velocity fluid flow at the surface of a wafer that results in results in high, uniform mass transfer providing more uniform plating at high plating rates. The apparatus includes a paddle which can provide uniform high mass transfer over the entire wafer, even with a relatively large gap between the paddle and the wafer. Consequently, the processor may have an electric field shield positioned between the paddle and the wafer, where the shield is more effective. In this design, with the paddle below the shield, the paddle is also less likely to adversely influence the electric field across the wafer. This advantage is particularly significant in processing where the wafer does not rotate, where such disturbances cannot be averaged out with wafer rotation.

BRIEF DESCRIPTION OF THE DRAWINGS

In the drawings, the same reference number indicates the same element in each of the views.

DETAILED DESCRIPTION

Figure 1:
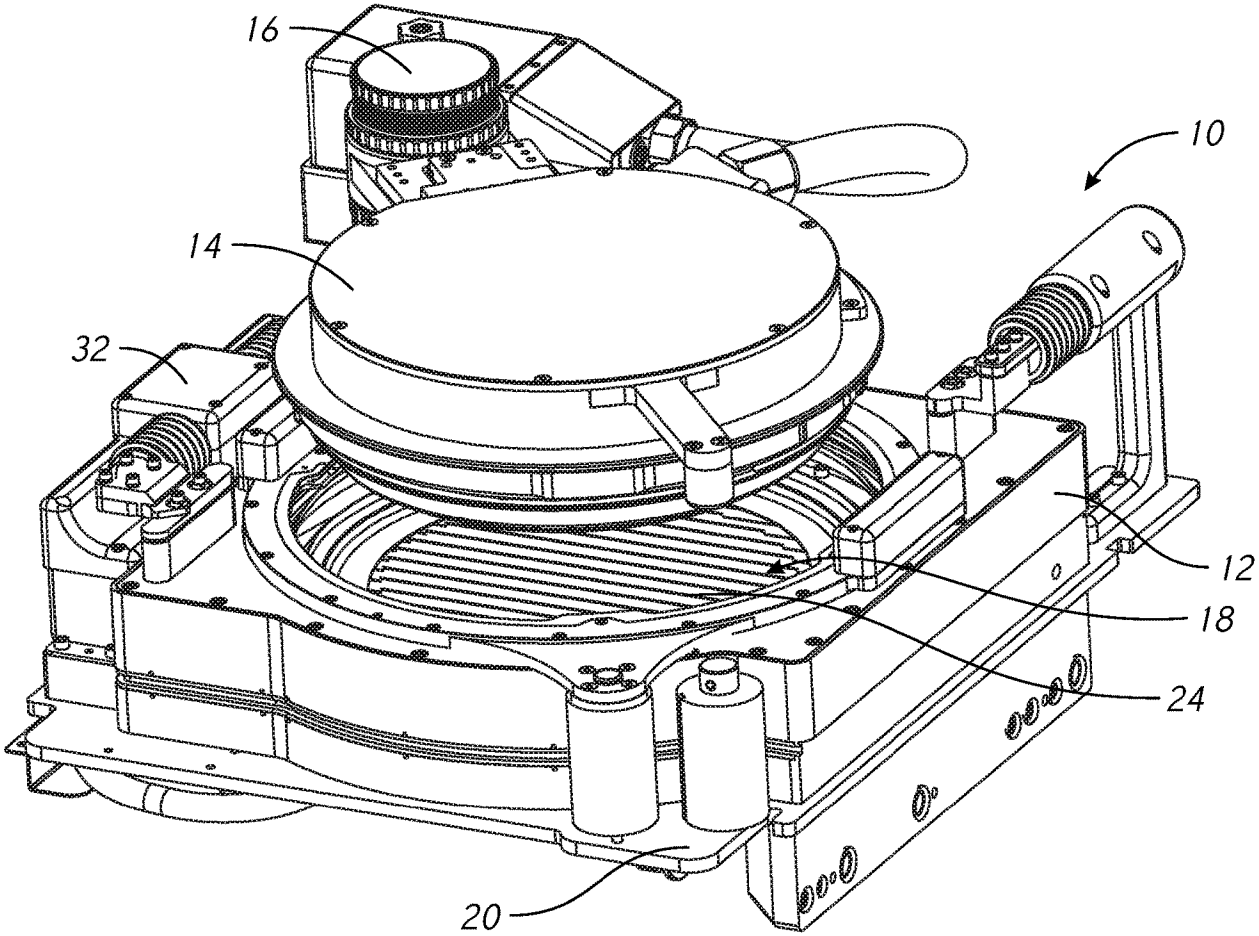
FIG. 1 is a top perspective view of an electroplating apparatus.
Figure 2:
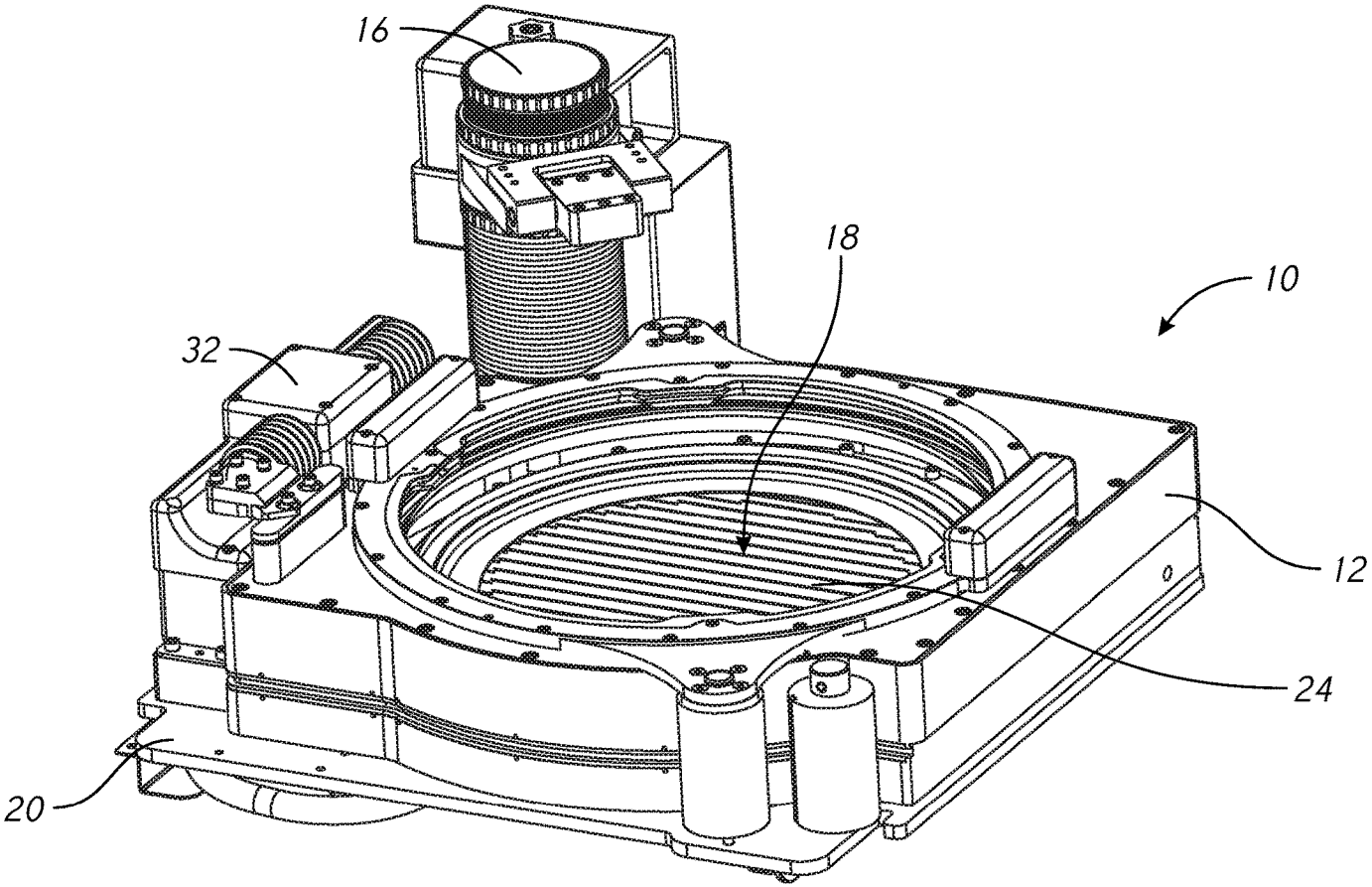
FIG. 2 is a top perspective view of the apparatus of FIG. 1 with the head removed for purpose of illustration.
Figure 3:
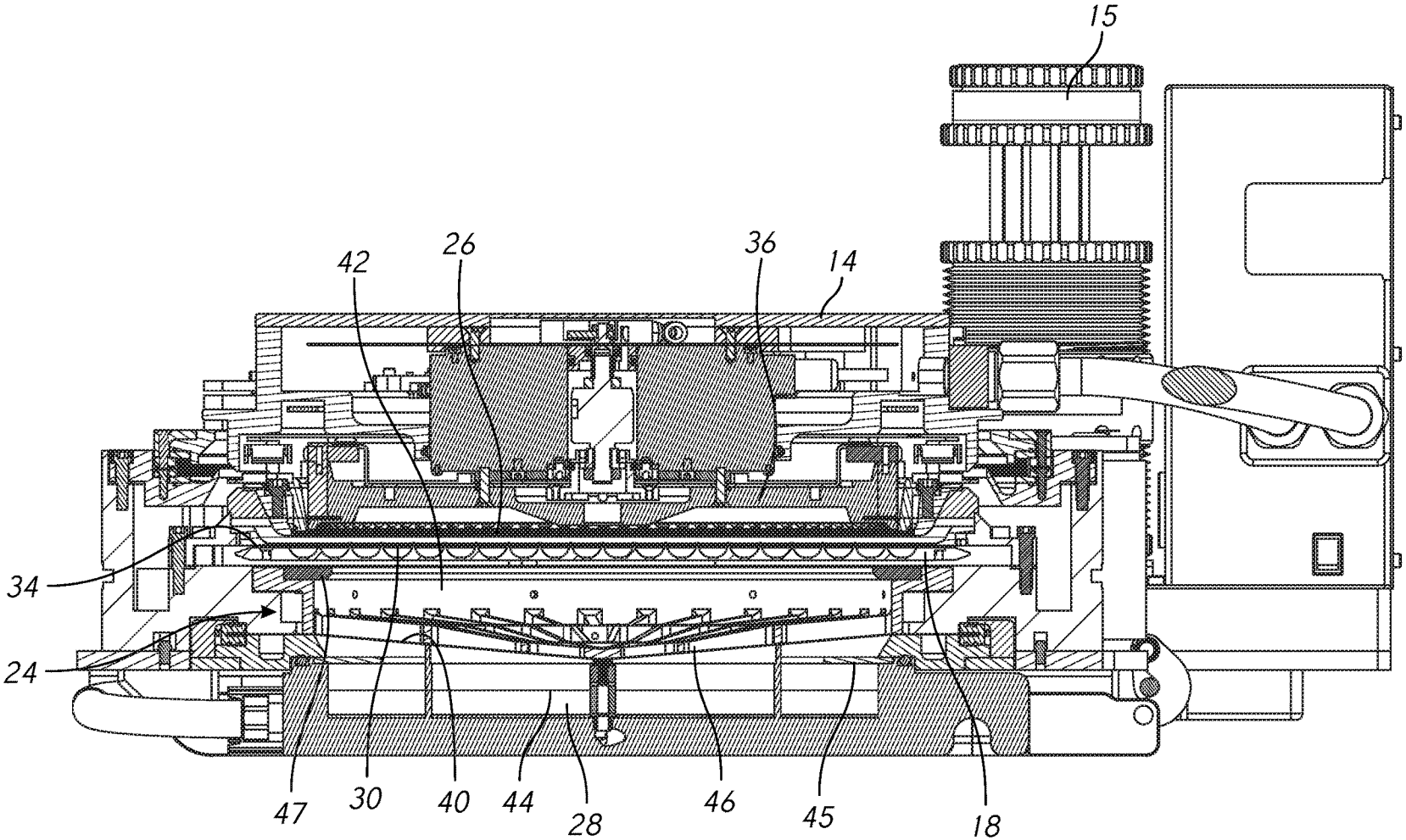
FIG. 3 is a section view of the apparatus of FIG. 1.

As shown in FIGS. 1-3, a processor 10 for electroplating a wafer 30 includes a head 14 supported on a head lifter 16 and a vessel 24. A membrane 40 may be included to divide the vessel 24 into a lower chamber 44 containing one or more anodes 28, and a first liquid electrolyte, below the membrane 40, and an upper chamber 42 containing a second liquid electrolyte. Alternatively the membrane 40 may be omitted with the vessel 24 having a single chamber holding a single electrolyte. Referring to FIG. 3, a field shaping element 46 made of a dielectric material may be provided in the vessel 24 primarily to support the membrane 40, and distribute flow of catholyte. The electric field in the vessel 24 may be shaped via an anode shield 45, a chamber shield 47, and a weir shield 34. The shields may be annular dielectric elements. The shields provide shielding of the electric field with the vessel.

A contact ring 26 on the head 14 holds the wafer 30 and has a plurality of contact fingers for making electrical contact with a conductive layer, such as a metal seed layer, on the wafer 30. The contact ring 26 may optionally have a seal 38 to seal the contact fingers from the electrolyte. The head 14 may include a rotor 36 for rotating the wafer 30 during processing, with the contact ring 26 on the rotor. Typically the contact ring has a seal and a backing plate, with the contact ring and the backing plate forming a wafer holder. The head 14 is movable to position the wafer holder into a processing position in the vessel, where the seed layer is in contact with electrolyte in the vessel.

Figure 4:
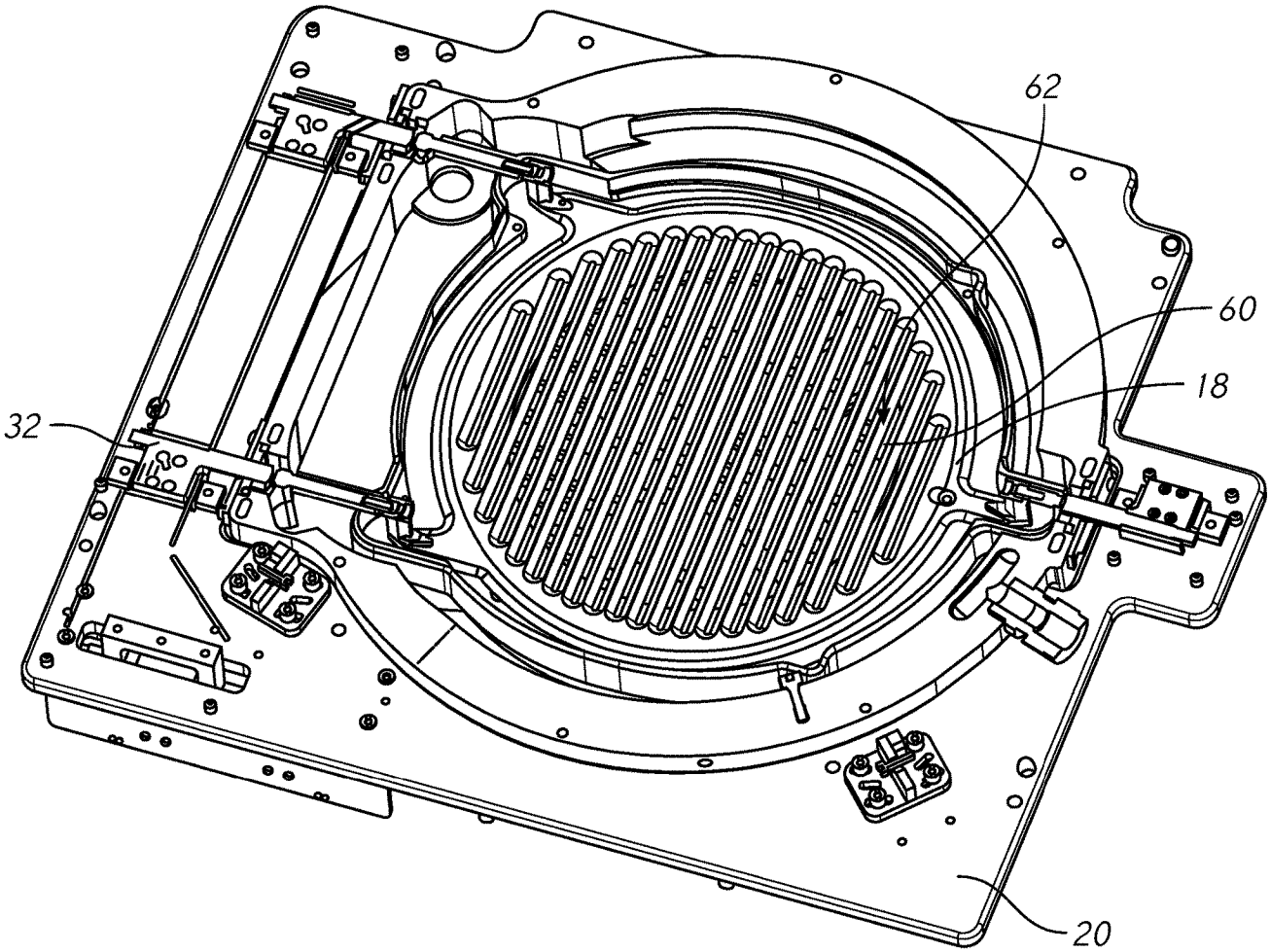
FIG. 4 is a top perspective view of the paddle shown in the apparatus of FIGS. 1-3.

Referring now also to FIG. 4, a paddle 18 is at a fixed vertical position within the vessel 24 adjacent to the wafer 30. The paddle 18 may be a generally circular plate of dielectric material having a plurality of parallel ribs or blades 60 spaced apart by slots 62. A paddle actuator 32 moves the paddle 18 horizontally in a flat plane, parallel to the wafer, within the vessel 24 to agitate the electrolyte 50. The paddle 18 and the paddle actuator 32 may be supported on a base plate 20 attached to the vessel 24.

Figure 5:
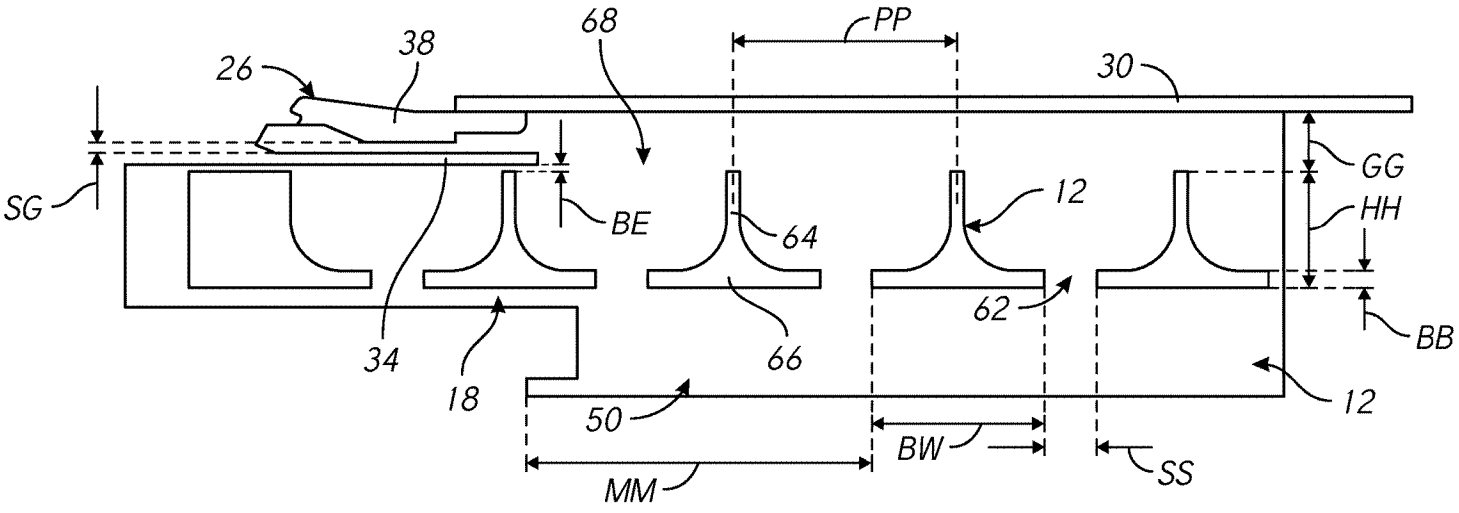
FIG. 5 is a schematic section view of the paddle shown in FIGS. 1-3.

As shown in FIG. 5, a weir shield 34 is provided in the vessel 24 between the paddle 18 and the seal 38 of the contact ring 26. Positioning the weir shield 34 above the paddle requires the gap GG between the top surface of the ribs 60 of the paddle 18 and the wafer 30, to be larger than if the weir shield 34 is positioned below the paddle 18. Generally, as the gap GG increases, the agitation on the wafer due to the paddle is reduced, which reduces the mass transfer rate and uniformity and the quality of the plating process.

With a seal 38 height of 2-3 mm (2.7 mm nominal), and allowing for a 1 mm gap SG between the seal 38 and the weir shield 34, a weir shield 34 thickness of 1 mm, and a gap BG of 1 mm between the top of the ribs and the weir shield 34, the minimum gap GG is about 5-6 mm (5.7 mm nominal).

Figure 6:
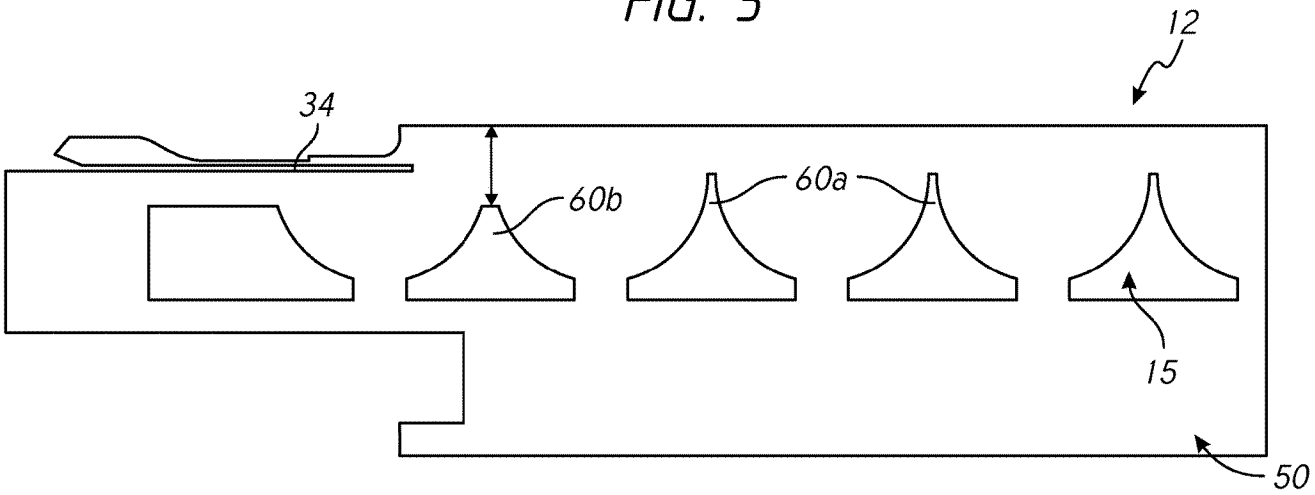
FIG. 6 is a schematic section view of a prior art paddle.

To achieve a smaller gap GG over most of the wafer 30, a raised rib paddle 15 as shown in FIG. 6 has been used, with the raised rib paddle 15 having taller ribs 60*a* over the interior portion of the paddle, where ribs are not at risk of hitting the weir shield 34. Shorter ribs 60*b* are used at the front and back of the paddle 15 (in the direction MM of paddle movement). The shorter ribs 60B on a first side of the paddle can move under the weir shield 34 at the limit of paddle travel in a first direction, to a position where the weir shield overlies one or more of the ribs, and the ribs do not collide with the weir shield 34. As the paddle moves to the limit of paddle travel in the opposite or second direction, the shorter ribs 60B on the first side of the paddle move out from under the weir shield, so that the weir shield then does not overlie the shorter ribs 60B. With a raised rib paddle 15, the gap GG over much of the wafer can be reduced to about 3-4 mm or less (3.7 mm nominal), rather than 5.7 mm. However, test results using the raised rib paddle 15 show a thinner plated film at the edges of the wafer, and that this results due to the shorter ribs 60*b*, which provide reduced mass transfer relative to the taller ribs 60*c*.

Referring once again to FIG. 5, with the paddle 18, plating is substantially uniform, including at the wafer edges. All of the ribs 60 on the paddle 18 may have the same height HH. Although the minimum gap GG is 5-6 mm, the paddle 18 achieves plating uniformity better than the raised rib paddle 15. The paddle 18 creates larger vortices, which maintains a high level of mass transfer. The ribs 60 are spaced much further apart in comparison to existing designs. For example, in FIG. 5 the ribs 60 may be equally spaced apart on at a pitch dimension PP (between centers of adjacent ribs) of 18-22 mm (20.6 mm nominal), with a rib height HH equal to 8-13 mm (10.5 mm nominal). As the paddle moves or oscillates in the vessel, the large space 68 between ribs 60 creates a large diameter vortex which reduces the diffusion layer at the wafer surface and improves mass transfer.

All of the ribs 60 may have the same cross section shape, dimensions and spacing, with the length of the ribs varying with rib position, as shown in FIG. 4. Referring back to FIG. 5, each rib 60 has an upright section 64 joined perpendicularly to a base 66 via radii. The radii may be omitted with straight ribs joined perpendicularly to a flat base. The slots or openings 62 between adjacent bases 66 have a width SS of 4-6 mm (5 mm nominal). Each base 66 has a width BW of 14-17 mm (15.6 mm nominal), and a base height or floor thickness BB of 1-2 mm. The upright section 64 may also have a width or thickness of 1-2 mm and a plurality of equally spaced apart upright ribs.

The inventors have discovered that there is a mathematical relationship between the gap GG and the pitch spacing PP (or alternatively the width of the space 68 formed between adjacent ribs).

$$PP=2.72\times GG+3.45 \text{ mm.} \quad 1.$$

$$\text{Space aspect ratio}=(HH-BB)/PP=0.3 \text{ to } 0.5 \text{ (0.44 nominal).} \quad 2.$$

Consequently, in processor design, the gap GG may be first determined based on the shield requirements and other factors. Then the paddle 18 may be designed with the pitch and height of the ribs selected to have an aspect ratio of 0.3 or 0.35 to 0.5, and PP is greater than 16, 17 or 18 mm, and up to 22 or 24 mm. Using these equations, the thickness BB of the base 66 is added to obtain the total rib height HH. Although the gap GG varies depending on dimensions of other elements and the design of the electroplating processor, the ratio of PP/GG may typically range from about 2.5 to 3.

Thus, a novel electroplating processor has been shown and described. Various changes and substitutions may of course be made without departing from the spirit and scope of the invention. The invention, therefore, should not be limited, except by the following claims, and their equivalents.

The invention claimed is:

1. An electroplating processor, comprising:

a vessel;

a head having a wafer holder, with the head movable to position the wafer holder in the vessel;

a contact ring on the head having a plurality of electrical contacts positioned for making electrical contact with a wafer held by the wafer holder;

at least one anode in the vessel;

a paddle in the vessel, with the paddle having a plurality of upright ribs, with substantially all of the ribs having a height HH, and with the ribs having a pitch spacing PP greater than 16 mm, and with ratio of HH:PP equal to 0.35 to 0.5;

a paddle actuator attached to the paddle for moving the paddle horizontally within the vessel; and a shield in between the wafer holder and the paddle, the shield comprising an annular ring of di-electric material in the vessel, the shield oriented in a horizontal plane, for shielding edges of a wafer held in the wafer holder.

2. The electroplating processor of claim 1 with the wafer holder holding a wafer at a processing position, with a gap of 4-6 mm between a lower surface of the wafer and a top surface of the ribs.

3. The electroplating processor of claim 1 with each rib having a tapering upright section joined perpendicularly to a base having a flat bottom surface, and with an opening of 4-6 mm between bases of adjacent ribs.

4. The electroplating processor of claim 3 with each base having a width BW and with BW equal to 70 to 95% of HH.

5. The electroplating processor of claim 1 with PP equal to 18 to 22 mm.

6. The electroplating processor of claim 1 with each rib having a tapering upright section joined perpendicularly to a base having a flat bottom surface.

7. The electroplating processor of claim 6 with the paddle actuator moving the paddle from a first position, wherein the shield overlies a first rib of the paddle, to a second position wherein the shield does not overlie the first rib.

8. The electroplating processor of claim 1 wherein the paddle is round and comprises a di-electric material, and substantially all of the ribs are equally spaced apart.

9. The electroplating processor of claim 5 with HH:PP equal to 0.4 to 0.5.

10. An electroplating processor, comprising:

a vessel;

a head having a wafer holder, with the head movable to position the wafer holder in the vessel;

a contact ring on the head having a plurality of electrical contacts positioned for making electrical contact with a wafer held by the wafer holder;

at least one anode in the vessel;

a paddle in the vessel, with the paddle having a plurality of equally spaced apart upright ribs, with substantially all of the ribs having a height HH, and with the ribs having a pitch spacing PP equal to 16 to 22 mm, and with ratio of HH:PP equal to 0.35 to 0.5 and with each rib having a tapering upright section joined perpendicularly to a base having a flat bottom surface;

the wafer holder holding a wafer at a processing position, with a gap of 4-6 mm between a lower surface of the wafer and a top surface of the upright section of substantially each rib;

a paddle actuator attached to the paddle for moving the paddle horizontally within the vessel;

a seal on the contact ring at a vertical level above the ribs; and a shield in between the wafer and the paddle, the shield comprising an annular ring of di-electric material in the vessel, the shield oriented in a horizontal plane, for shielding edges of a wafer held in the wafer holder.

11. The electroplating processor of claim 1 with the paddle comprising a circular di-electric material.

12. The electroplating processor of claim 1 with the paddle at a fixed vertical position in the vessel.

13. The electroplating processor of claim 1 further including a seal on the contact ring at a vertical level above the ribs.

14. An electroplating processor, comprising:

a vessel;

a head having a wafer holder, with the head movable to position the wafer holder in the vessel;

a contact ring on the head having a plurality of electrical contacts positioned for making electrical contact with a wafer held by the wafer holder;

at least one anode in the vessel;

a paddle in the vessel, with the paddle having a plurality of equally spaced apart upright ribs, with substantially all of the ribs having a height HH, and with the ribs having a pitch spacing PP greater than 16 mm, and with ratio of HH:PP equal to 0.35 to 0.5, and with each rib having a tapering upright section joined perpendicularly to a base having a flat bottom surface;

a paddle actuator attached to the paddle for moving the paddle horizontally within the vessel;

a shield in the vessel, the shield comprising an annular ring of di-electric material in the vessel, the shield oriented in a horizontal plane, for shielding edges of a wafer held in the wafer holder.

15. The electroplating processor of claim 14 wherein the tapering section has curved surfaces.

16. The electroplating processor of claim 14 with the wafer holder holding a wafer at a processing position, with a gap of 4-6 mm between a lower surface of the wafer and a top surface of the ribs.

17. The electroplating processor of claim 14 with each base having a width equal to 70 to 95% of HH.

18. The electroplating processor of claim 14 with PP equal to 18 to 22 mm.

19. The electroplating processor of claim 14 with the paddle actuator moving the paddle from a first position, wherein the shield overlies a first rib of the paddle, to a second position wherein the shield does not overlie the first rib.

* * * * *